US011545762B2

(12) United States Patent
Zhang et al.

(10) Patent No.: US 11,545,762 B2
(45) Date of Patent: Jan. 3, 2023

(54) MULTI-SYSTEM MULTI-BAND ANTENNA ASSEMBLY WITH ROTMAN LENS

(71) Applicant: The Boeing Company, Chicago, IL (US)

(72) Inventors: Henry Z. Zhang, Bellevue, WA (US); Guillermo H. De Vivero, Everett, WA (US); Anil Kumar, Sammamish, WA (US); Daniel J. Ellis, Bellevue, WA (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 17/392,644

(22) Filed: Aug. 3, 2021

(65) Prior Publication Data

US 2022/0059935 A1 Feb. 24, 2022

Related U.S. Application Data

(60) Provisional application No. 63/067,151, filed on Aug. 18, 2020.

(51) Int. Cl.

| | |
|---|---|
| ***H01Q 25/00*** | (2006.01) |
| ***H01Q 1/28*** | (2006.01) |
| ***H01Q 3/32*** | (2006.01) |
| ***H01Q 5/40*** | (2015.01) |
| ***H01Q 15/06*** | (2006.01) |

(52) U.S. Cl.

CPC ..... *H01Q 25/008* (2013.01); *H01Q 1/283* (2013.01); *H01Q 3/32* (2013.01); *H01Q 5/40* (2015.01); *H01Q 15/06* (2013.01)

(58) Field of Classification Search

CPC ..... H01Q 1/283; H01Q 1/28; H01Q 15/06

See application file for complete search history.

(56) References Cited

U.S. PATENT DOCUMENTS

| | | | | |
|---|---|---|---|---|
| 6,275,184 | B1 * | 8/2001 | Hemmi | H01Q 21/0031 342/354 |
| 6,304,225 | B1 * | 10/2001 | Hemmi | H01Q 21/22 343/753 |
| 6,690,333 | B2 * | 2/2004 | Eiges | H01Q 3/242 343/757 |
| 8,130,171 | B2 * | 3/2012 | Lam | H01Q 15/0086 343/872 |
| 9,391,375 | B1 * | 7/2016 | Bales | H01Q 21/064 |
| 10,862,199 | B1 | 12/2020 | Zhang et al. | |
| 11,411,324 | B2 * | 8/2022 | Fillion | H01Q 3/26 |
| 2002/0163480 | A1 * | 11/2002 | Eiges | H01Q 25/008 343/911 L |

(Continued)

OTHER PUBLICATIONS

Extended European Search Report dated Jan. 20, 2022 for European Patent Application No. 21185404.7.

*Primary Examiner* — Ab Salam Alkassim, Jr.
(74) *Attorney, Agent, or Firm* — Gates & Cooper LLP

(57) ABSTRACT

A method and apparatus for communicating RF signals is described. In one embodiment, the apparatus is evidenced by a multi-band integrated antenna assembly comprising a blade antenna having a conductive ground plane, a planar antenna array for communicating a second signal, and a signal processor. The planar antenna array transmits and receives signals using a passive Rotman lens beam former that can be utilized in environmentally challenging applications.

20 Claims, 13 Drawing Sheets

(56) References Cited

U.S. PATENT DOCUMENTS

| | | | | |
|---|---|---|---|---|
| 2002/0171585 | A1* | 11/2002 | Eiges | H01Q 25/00 342/361 |
| 2006/0229076 | A1* | 10/2006 | Monk | H04W 16/28 455/442 |
| 2006/0229104 | A1 | 10/2006 | de La Chapelle et al. | |
| 2011/0285598 | A1* | 11/2011 | Oota | H01Q 25/008 343/833 |
| 2013/0120216 | A1* | 5/2013 | Delfeld | H01Q 21/0006 343/858 |
| 2014/0327577 | A1* | 11/2014 | Ozaki | H01Q 25/00 343/705 |
| 2016/0064807 | A1 | 3/2016 | Reed et al. | |
| 2016/0205560 | A1 | 7/2016 | Hyslop et al. | |
| 2017/0033450 | A1 | 2/2017 | Feng et al. | |
| 2017/0064807 | A1 | 3/2017 | Ilic et al. | |
| 2017/0187105 | A1 | 6/2017 | Emerick et al. | |
| 2019/0036228 | A1* | 1/2019 | Tubau | H01P 5/19 |
| 2019/0089419 | A1 | 3/2019 | Kim et al. | |
| 2019/0288390 | A1* | 9/2019 | Palreddy | H01Q 15/06 |
| 2020/0083611 | A1* | 3/2020 | Hasegawa | H01P 5/12 |
| 2020/0212978 | A1 | 7/2020 | Zhao et al. | |
| 2021/0075096 | A1* | 3/2021 | Rogers | H01Q 21/065 |
| 2021/0083376 | A1* | 3/2021 | Rogers | H01Q 15/08 |
| 2022/0216601 | A1* | 7/2022 | Schaupmann | B64C 1/36 |

* cited by examiner

MULTI-SYSTEM MULTI-BAND ANTENNA ASSEMBLY WITH ROTMAN LENS

CROSS-REFERENCE TO RELATED APPLICATIONS

This application claims benefit of U.S. Provisional Patent Application No. 63/067,151, entitled "MULTI-SYSTEM MULTI-BAND ANTENNA ASSEMBLY WITH ROTMAN LENS," by Henry Zhang, Guillermo De Vivero, Anil Kumar and Daniel Ellis, filed Aug. 18, 2020, which application is hereby incorporated by reference herein.

BACKGROUND

1. Field

The subject disclosure relates to systems and methods for communicating information via antennas, and in particular on a system of multi-band antennas.

2. Description of the Related Art

Existing wireless communication systems deploy their own antenna for a single band for an omni-directional coverage area. Multiple systems need to deploy multiple antennas for the specified band and coverage. Configuration of the multiple antennas requires a large surface area. It competes for the extremely valuable real estate with other systems in a vehicle with limited surface area. In addition, the congested antenna farm raises interference with other installed systems onboard. The multiple antennas also add to the weight and aerodynamic drag of the vehicle, negatively.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

To address the requirements described above, this document discloses a multi-band integrated antenna assembly. In one embodiment, the assembly comprises a blade antenna for communicating a first signal, a planar antenna array for communicating a second signal, and a signal processor.

The planar antenna array comprises an array of antenna elements, and a Rotman lens using the blade antenna as a conductive ground plane. The array of antenna elements comprises a plurality antenna elements arranged in rows.

The Rotman lens has a set of Rotman lens array ports and set of Rotman lens beam ports. Each element of a respective row of the antenna elements is communicatively coupled to a respective one port of the set of Rotman lens array ports.

The signal processor comprises a set of signal processor first ports, each signal processor first port communicatively coupled to a respective one of the Rotman lens beam ports, and a second signal processor port for communicating a second signal. The signal processor selectively couples the second signal processor port to one of the signal processor first ports.

Other embodiments are evidenced by a method of communicating one or more RF signals using the blade antenna, and the planar antenna array and optionally, doing so concurrently.

The foregoing integrated antenna assembly supports multiple wireless systems and a wide range of frequency bands. The integrated antenna assembly comprises an omnidirectional blade antenna and one or more antenna arrays on the sides of the assembly. The antenna arrays on the side cover the entire horizontal range (360 degrees azimuth angle), and the blade antenna simultaneously provides typical omnidirectional radiation coverage for the same or different frequency bands, and can be replaced with a panel housing multiple monopole antennas for multiple input multiple output (MIMO) operation.

The foregoing system supports communications in LTE/5G-sub6 and mm Wave bands with a single antenna assembly, reduction in spatial volume needs (including stay-out zones for equipment retention, accessibility, and maintainability), reduction in vehicle weight by eliminating multiple antennas, support of next generation of antenna communication and control (e.g. electronically steered, beam forming), and lower cost by removing the phased array control electrical circuitry.

The features, functions, and advantages that have been discussed can be achieved independently in various embodiments of the subject disclosure or may be combined in yet other embodiments, further details of which can be seen with reference to the following description and drawings.

BRIEF DESCRIPTION OF THE DRAWINGS

Referring now to the drawings in which like reference numbers represent corresponding parts throughout.

DESCRIPTION

Figure 1A:
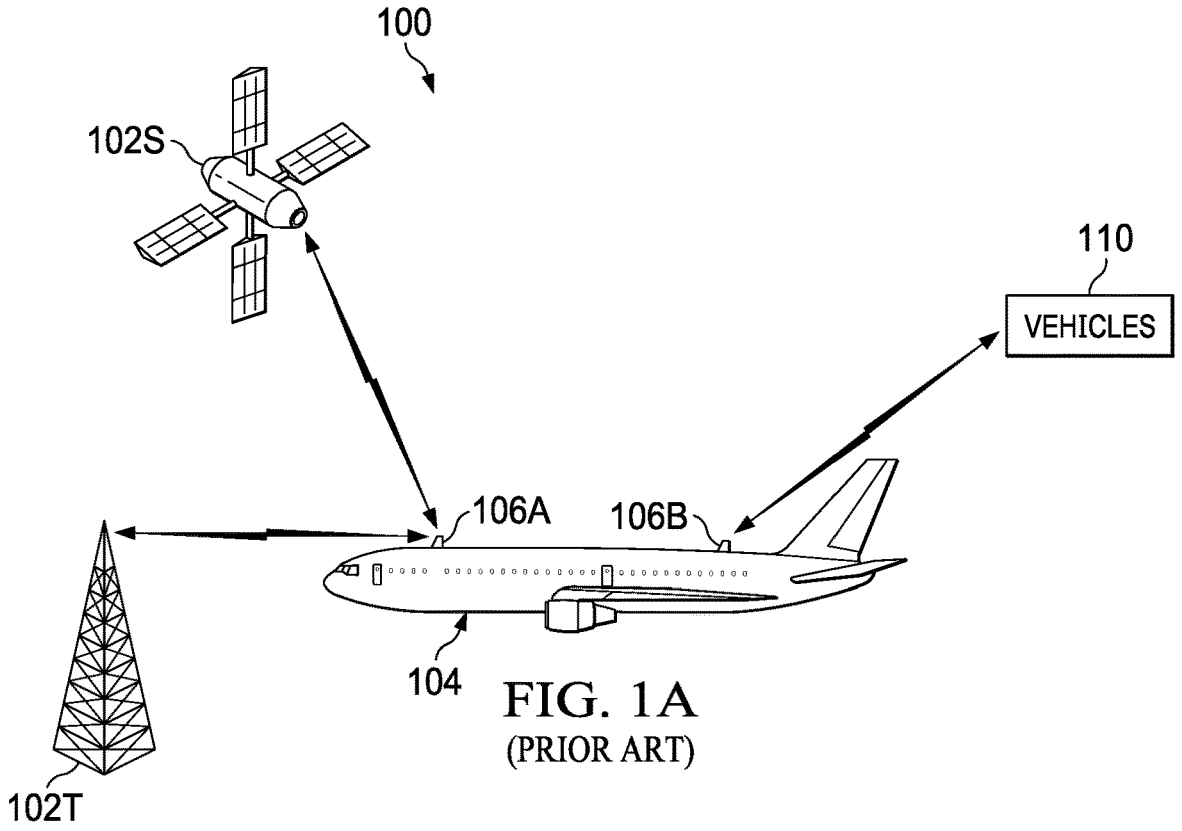
FIG. 1A (PRIOR ART)
FIG. 1A is a diagram of a communication system.

In the following description, reference is made to the accompanying drawings which form a part hereof, and which is shown, by way of illustration, several embodiments. It is understood that other embodiments may be utilized and structural changes may be made without departing from the scope of the subject disclosure.

Overview

The systems and methods disclosed herein consolidates multiple antennas and antenna arrays for multiple systems having multiple use cases into one single antenna assembly. It provides omnidirectional coverage for the lower frequency band, such as 4G/long term evolution (LTE)/Fifth Generation (5G)-sub 6 GHz band (below 6 GHz), and directional beam coverage for the higher frequency bands, such as 5G-millimeter wave (mm Wave) bands from 7 GHz to 86 GHz, or X, Ku, K, Ka and V frequency bands, simultaneously. It addresses installation, operational, performance and maintainability challenges inherent with deploying multiple wireless communication systems in a constrained environment such as an air, terrestrial, maritime or space vehicle. The compact physical size of the assembly reduces the installation limitations caused by finite installation surface area and the resulting co-site restriction, and weight and aerodynamic drag on the vehicle. The assembly with antenna arrays solves the concerns of insufficient antenna gain for the higher frequency band. The assembly with antenna arrays also solves the electrical performance concerns such as lack of electrical scanning capability, inability for spatial multiplex and limited connectivity link range. The single assembly solves the maintainability challenges such as maintenance and replacement costs for multiple antennas.

The assembly combines one or more blade antenna (for example, for LTE/5G-sub 6 GHz cellular communication) with one or more phased array antennas (for example, for 5G millimeter wave cellular/satellite communication). The blade antenna operate in a lower frequency band while the antenna arrays operate in a higher frequency band. The assembly is compact, provides 360° coverage, and addresses the concerns of limited real estate, weight and aerodynamic drag in vehicles traveling in constrained environments, including air, terrestrial, or maritime. The assembly simplifies vehicle design and manufacture while also reducing overall weight. The assembly can also be used in other applications having physically constrained environments such as aerospace, automotive, and/or maritime.

The antenna assembly also makes use of a Rotman lens to provide signals to each of the phased array antennas. The Rotman lens is used for beam scanning. This permits expensive and fragile phased array control beams scanning circuitry that would otherwise be disposed within the antenna assembly itself (and exposed to harsh environments such as extremely high and low temperatures) to be largely eliminated or disposed within an interior volume of the vehicle to which the assembly is mounted. Mounting the phased array controls circuitry within the vehicle also increases the reliability of such control circuitry, permitting fewer inspections, less maintenance, and a reduced need for spare parts. In one embodiment the array of radiation elements with the Rotman lens is disposed on a large ground plane that operates as a blade antenna. The phased array antennas provide 360 degree azimuthal directional beam coverage at higher frequency bands while the large ground plane (operating as a blade antenna) concurrently provides omnidirectional radiation coverage for the same and/or different frequency bands.

This antenna assembly provides, within a single housing, a plurality of antenna arrays that cover the entire horizontal range (360 degrees in azimuth) in 5G-mmWave frequency bands, and multiple ground planes, operating as multiple blade antennas which provide MIMO operation for lower frequency bands, such as 4G/LTE or 5G-sub6 cellular standard compliant frequency bands. The antenna assembly can be raised by an extension portion to reduce the size of the base and improve radiation coverage.

Typical Communication System

FIG. 1A is a diagram of a typical communication system 100. The communication system comprises a vehicle 104 such as an aircraft having a fuselage and wings attached thereto, and transceivers 102, which can include one or more of a terrestrial transceiver 102T and an airborne or satellite transceiver 102S and other vehicles 110, including communication with other vehicles 110 equipped with similar capabilities for communication. The vehicles 104 and 110 can be an aircraft, a water vessel, space vehicle, or a ground vessel.

The vehicle 104 includes one or more antenna systems 106A and 106B. The antenna systems 106A and 106B are used to communicate data that can include passenger or crew communication data (e.g. cellphone person-to-person communications, Internet communications via the passenger internet service provider (ISP) or an ISP provided by the vehicle 104), as well as avionics and/or cockpit data.

Figure 1B:
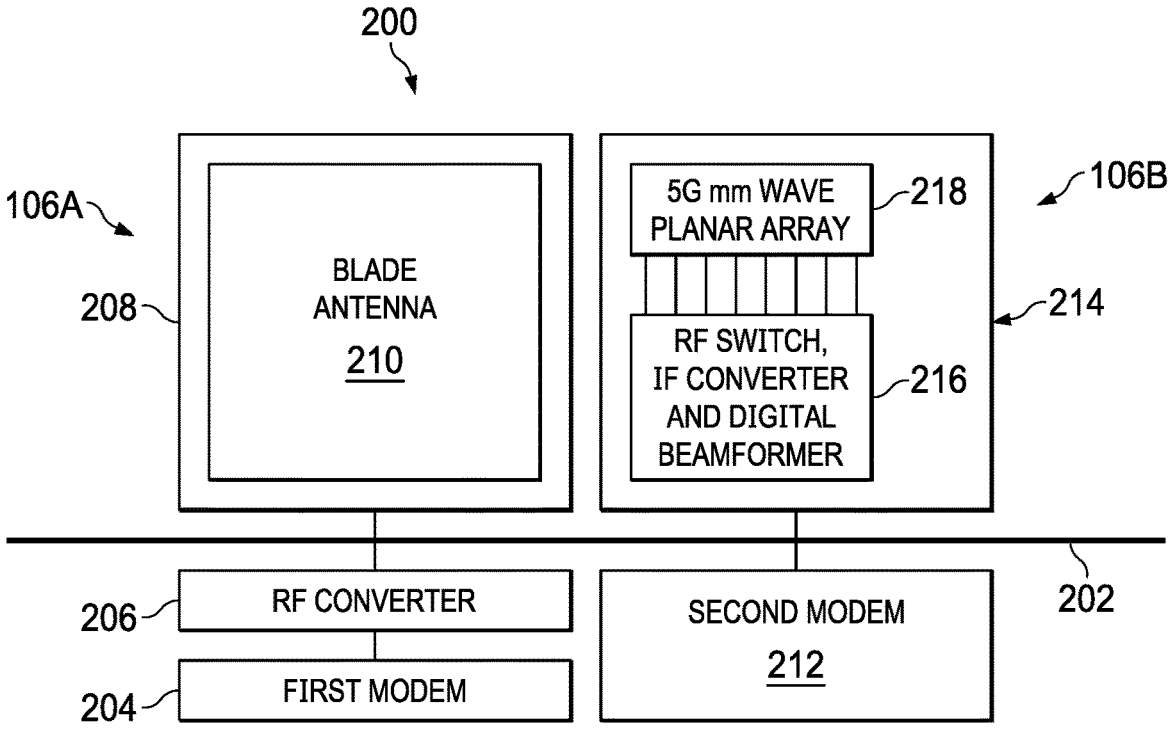
FIG. 1B (PRIOR ART)
FIG. 1B is a diagram depicting a typical antenna arrangement used to communicate signals.

FIG. 1B is a diagram depicting a typical antenna arrangement 200 used to communicate signals. The antenna arrangement 200 comprises a first antenna system 106A for communicating in a first set of frequency bands such as those that support 4G/LTE or 5G sub-6 communications systems. The first antenna system 106A comprises a first modem 204 such as a 4G/LTE modem communicatively coupled to a radio frequency (RF) converter 206. The first modem 204 modulates outgoing signals for transmission, and provides the modulated signals to the communicatively coupled RF converter 206, which converts the modulator signals to the RF frequencies used for transmission by the blade antenna 210 communicatively coupled thereto. The blade antenna 210 receives incoming signals, and provides those incoming signals to the RF converter 206 four down conversion to frequencies suitable for the modem 204. The modem 204 the modulates the signals from the RF converter 206. The blade antenna 210 is typically a simple metal plane, provides omnidirectional reception and transmission of signals, and is disposed in a first antenna system housing 208.

The antenna arrangement 200 also comprises a second antenna system 106B for communicating in a second set of frequency bands such as those that support the 5G mm Wave communication systems. The second antenna system 106B comprises a second modem 212 (such as a 5G modem 212), communicatively coupled to a communication module 216. The 5G modem 212 modulates outgoing signals for transmission, and demodulates incoming signals for reception. The communication module 216 performs intermediate frequency (IF) conversion to and from RF frequencies, RF switching, and digital beam forming functions. The communication module 216 is communicatively coupled to a planar array 218, described further below. As illustrated in FIG. 2, the planar array 218 and the communication module 216 are disposed in a second antenna assembly housing 214.

As illustrated in FIG. 1B, the first antenna system 106A and the second antenna system 106B are formed by separate structures, and are disposed in separate housings 208 and 214. Hence, the first antenna system 106A and the second antenna system 106B do not form an integrated structure. The first antenna system 106A and the second antenna system 106B are typically disposed a considerable distance from one another, as illustrated in FIG. 1.

FIG. 1B also discloses that the RF converter 206 and modem 204 of the first antenna system 106A and the modem 212 of second antenna system 106B is disposed on opposing side of the vehicle exterior surface or skin 202 from the first antenna system housing 208 and the second antenna assembly housing 214. Since the communication module 216 is disposed external to the vehicle, it is exposed to temperature and pressure extremes.

Integrated Antenna Assembly

Figure 2A:
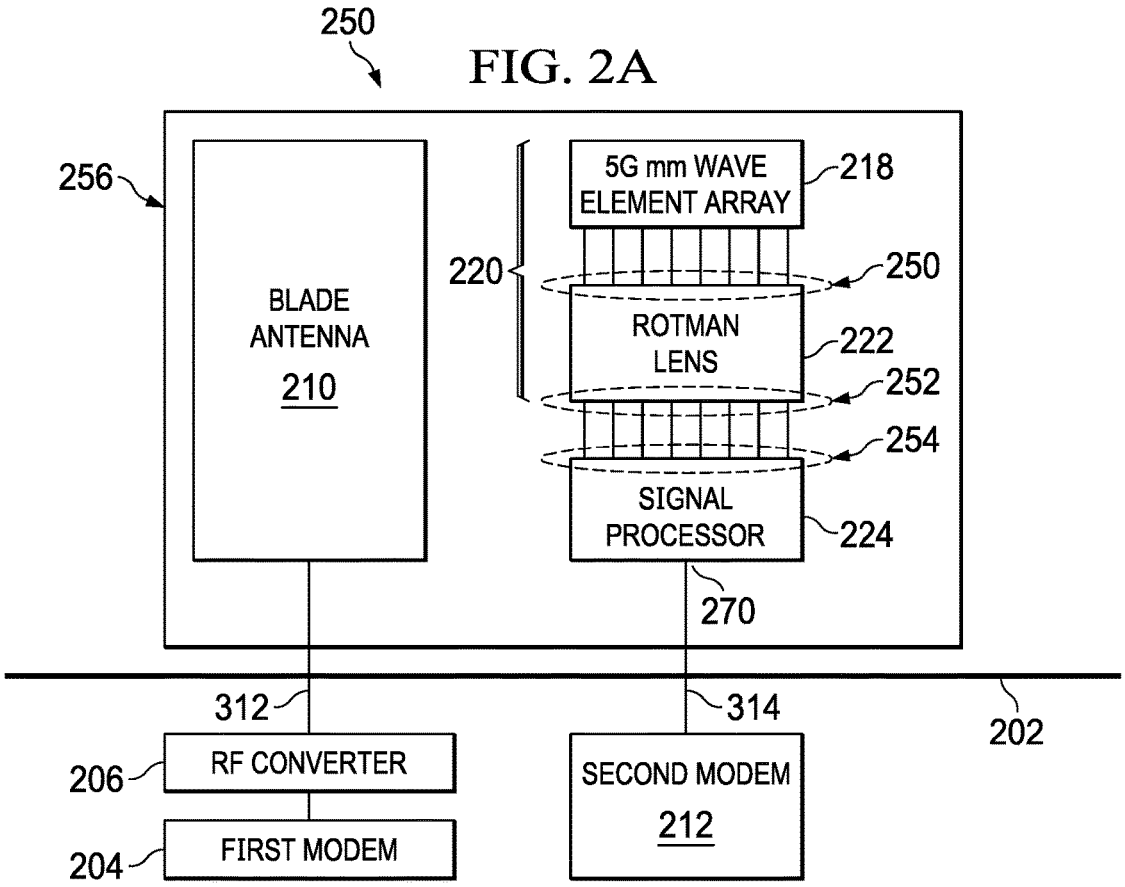
FIGS. 2A-2B are a functional block diagrams of an exemplary embodiment of an integrated of antenna assembly.
Figure 2B:
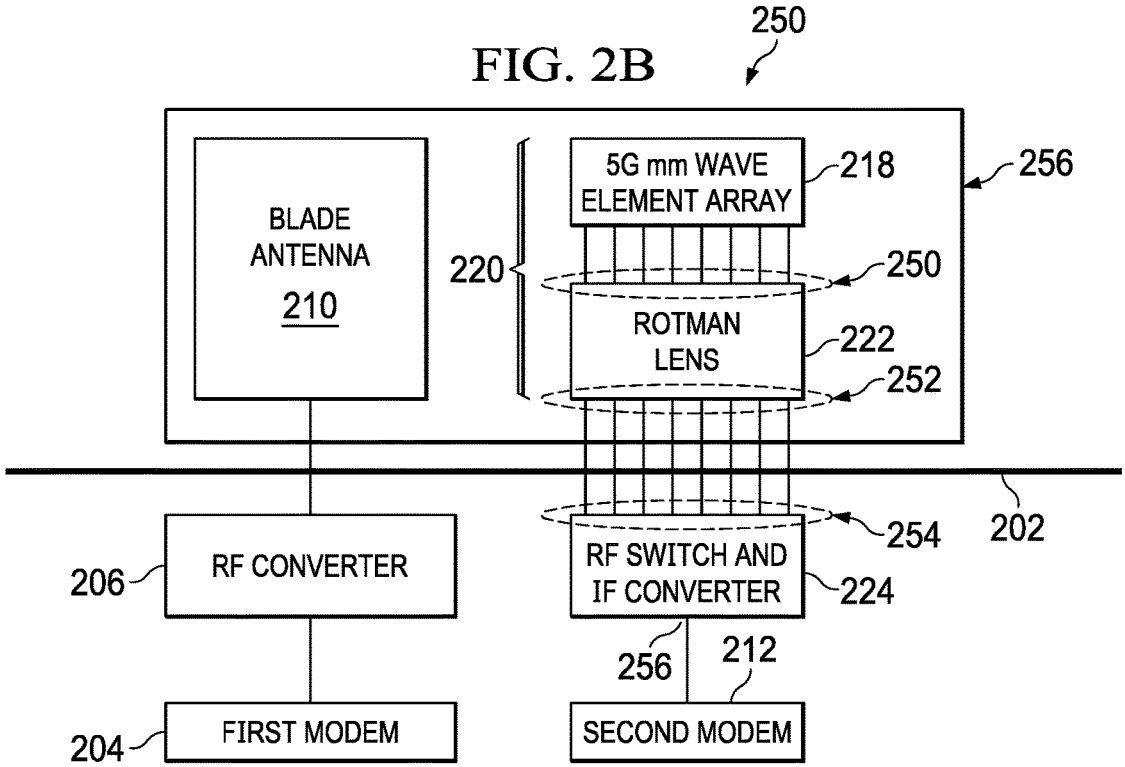

FIGS. 2A-2B are functional block diagrams of an exemplary embodiment of an integrated of antenna assembly (IAA) 250. FIG. 2A is discussed with reference to FIG. 3A, which is a diagram illustrating further details of the IAA 250.

The IAA 250 comprises the blade antenna 210, a planar antenna array 220, and a signal processor 224 (e.g., comprising an RF switch and IF converter). In one aspect, the blade antenna 210 is formed by conductive ground plane 310, for example by a conductive layer of a circuit board or a substrate having a conductive material in the desired shape of the ground plane 310. The blade antenna 210 communicates a first signal provided by a communicatively coupled RF converter 206 and first modem 204 by conductor 312.

The planar antenna array 220 communicates signals from a communicatively coupled second modem 212, and comprises an array 218 of antenna elements 302 arranged in rows 306. The antenna elements 302 can be formed by conductive surfaces on the top layer of the circuit board. In some examples, the first modem 304 can be used for 4G/LTE (fourth generation/long term evolution) communication, and the second modem used for 5G or future network communication.

Rotman Lens

The planar antenna array 220 also comprises a Rotman lens 222. The Rotman lens 222 is a passive microwave lens-based beamforming system that passively transforms a signal presented at one of the Rotman lens beam ports 252A-252H from a first phase and first amplitude to another signal at one or more of the Rotman lens array ports 254A-354H having a second phase and a second amplitude. The Rotman lens 222 also phase and amplitude shifts signals presented at the Rotman lens array ports 254A-254H and applies those phase and amplitude shifted signals to the Rotman lens beam ports 252A-252H.

Rotman lenses 222 use the free-space wavelength of a signal injected into a geometrically configured waveguide to passively shift the phase of inputs into a linear antenna array in order to scan a beam in any desired signal pattern. It has a shape and appropriate length transmission lines in order to produce a wave-front across the output that is phased by the time-delay in the signal transmission. The Rotman lens 222 achieves beam scanning using equivalent time delays that are created by the different path lengths to the radiating elements.

These lengths depend on the relative position between the beam ports 252A-252H and the array ports 251A-251H on the structure. As long as the path lengths exhibit constant time-delay behavior over the bandwidth, the lens is insensitive to the beam squint problems exhibited by constant phase beamformers. Each input port will produce a distinct beam that is shifted in angle at the system output.

The design of the Rotman lens 222 is determined by a series of equations that set the focal points and array positions. The inputs, during the design of the system, include the desired number of beams and array elements and the spacing of the elements. In the embodiment shown in FIG. 3, the Rotman lens 222 comprises eight beam ports 252A-252H and eight array ports 251A-251H, but a greater or fewer number of either beam ports or array ports 251A-251H can be implemented.

The Rotman lens 222 comprises a set 251 of Rotman lens array ports 251A-251H, and a set 252 of Rotman lens beam ports 252A-252H. Each of the Rotman lens array ports 251A-251H is communicatively coupled to a respective row 306 of the array 218 of antenna elements 302 by conductive traces 316 in a circuit board.

The planar antenna array 220 also comprises a signal processor 224. The signal processor 224 includes a set 254 of signal processor first ports 254A-254H, with each of the signal processor first ports 254A-254H communicatively coupled to a respective one of the Rotman lens beam ports 252A-252H via conductive traces 317, thus forming microstrip feeds. The signal processor 224 also includes a second port 270 for communicating the second signal to and from the second modem 212. The signal processor 224 operates as a switch, and selectively couples the second port 270 to one of the processor first ports 254A-254H, according to the beam that is to be formed. The digital beam forming functionality of the communications module 216 of FIG. 2A is performed by Rotman lens 222, with the remaining functionality (RF switching and optionally IF conversion) performed by signal processor 224.

Figure 3A:
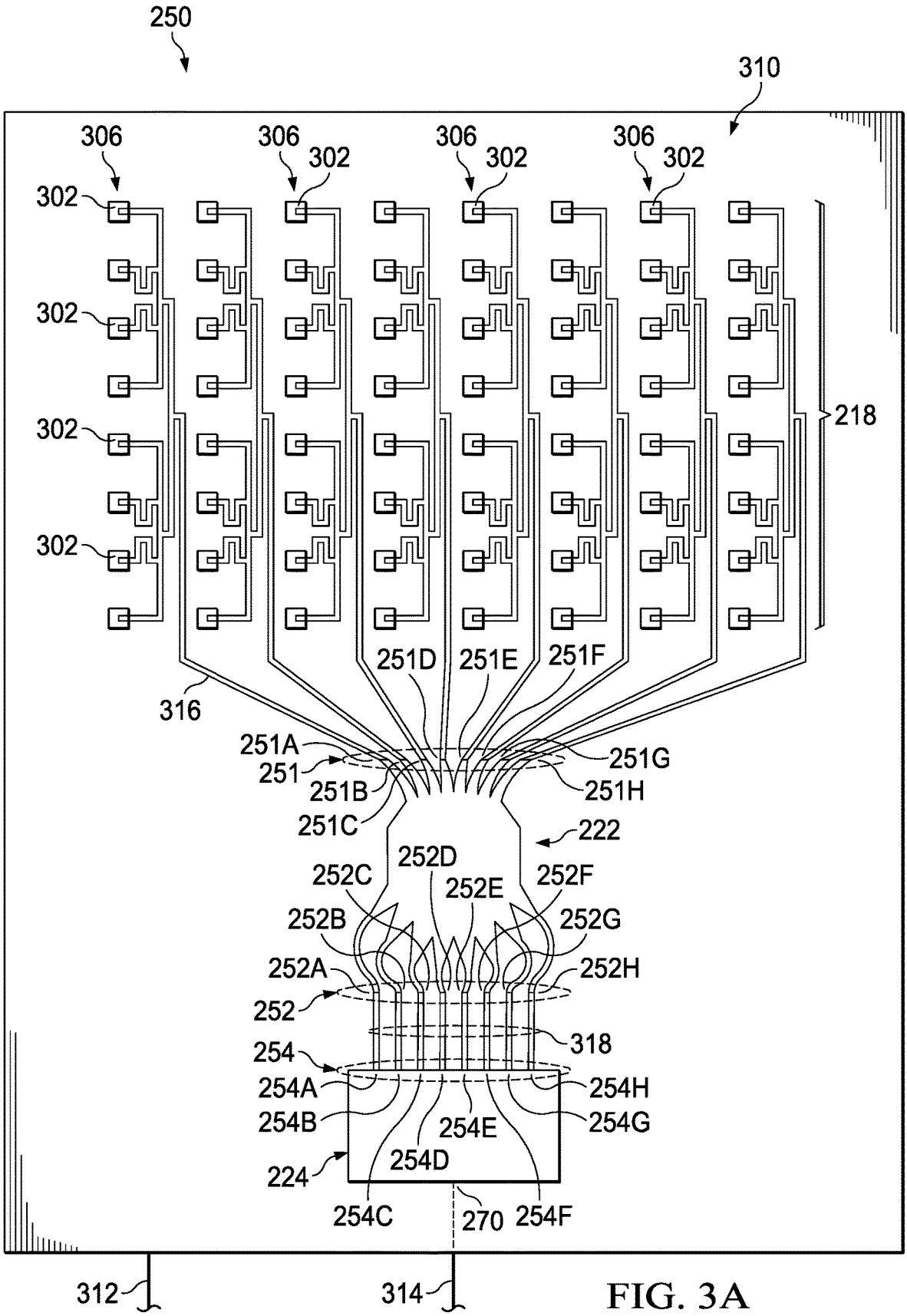
FIG. 3A is a diagram illustrating a diagram depicting further details of the integrated antenna assembly presented in FIG. 2A.
Figure 3B:
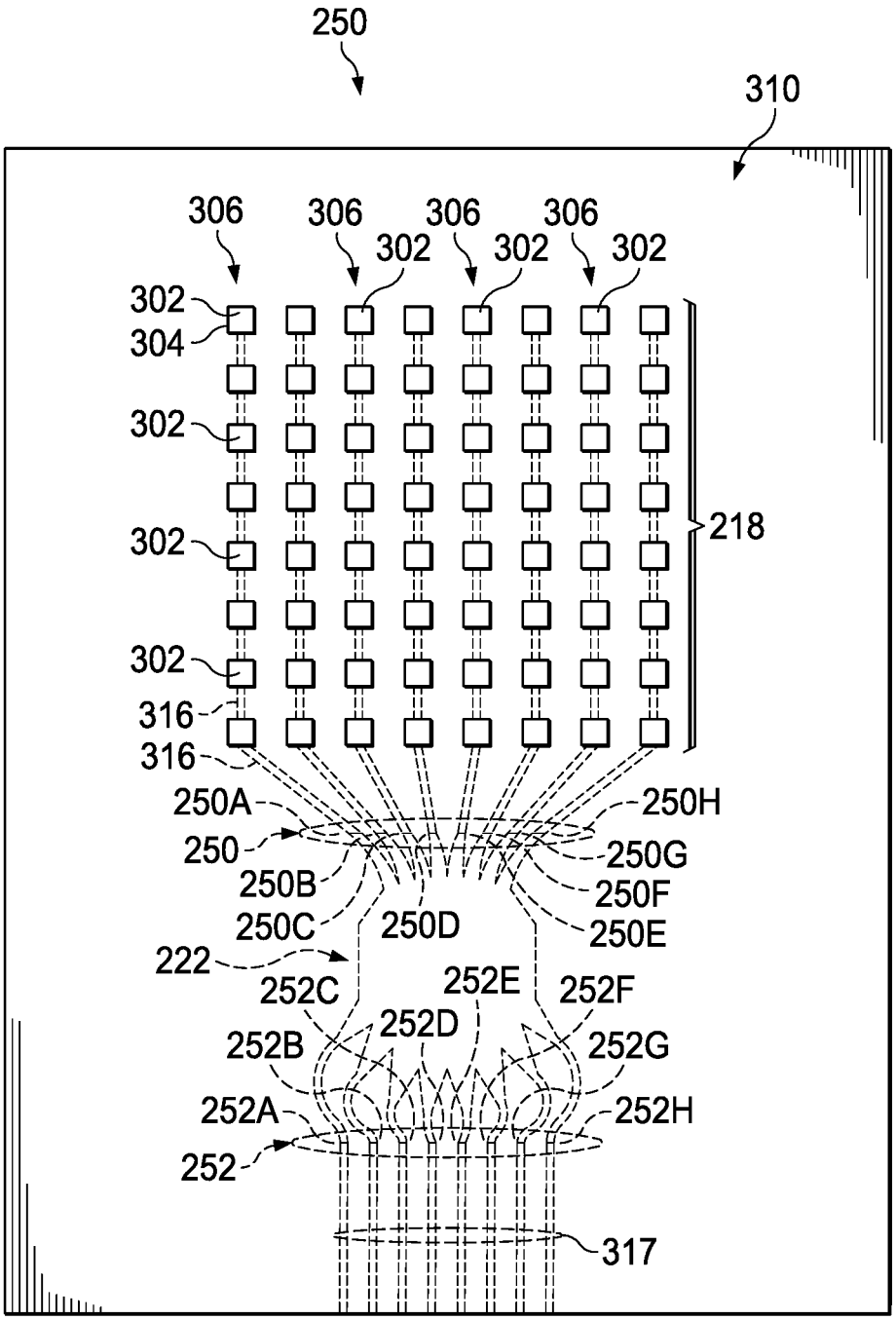
FIG. 3B is a diagram illustrating a diagram depicting further details of the integrated antenna assembly presented in FIG. 2A.
Figure 3C:
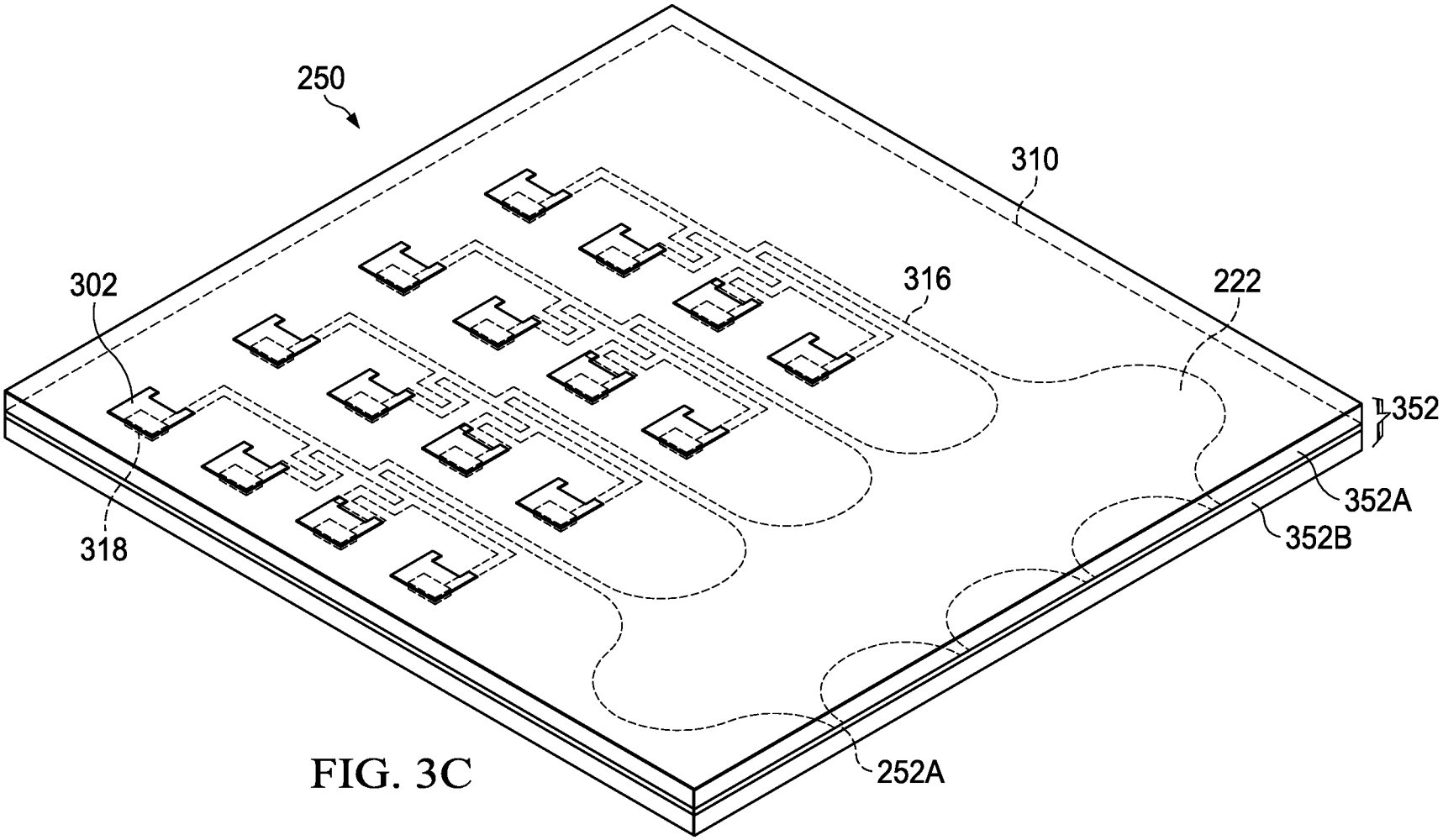
FIGS. 3C and 3D are diagrams of a multi-layer substrate used to implement an embodiment of the integrated antenna assembly.

FIG. 3C is a diagram of the IAA 250 fashioned from a multi-layer substrate 352. The multi-layer substrate 352 comprises a top layer 352A or top substrate and a bottom layer 352B or bottom substrate. Antenna elements 302 are disposed on a top surface of the top layer 352A, and the conductive ground plane 310 is disposed between the top layer 352A and the bottom layer 352B, either on a top surface of the bottom layer 352B or a bottom surface of the top layer 352A. The Rotman lens 222, and circuit traces 316 interconnecting the signal processor 224, and the Rotman lens 222 are disposed on the bottom surface of the bottom layer 352B. The conductive ground plane 310 comprises apertures 318 disposed beneath the antenna elements 302, coupling the microstrips 316 to the antenna elements 302.

Figure 3D:
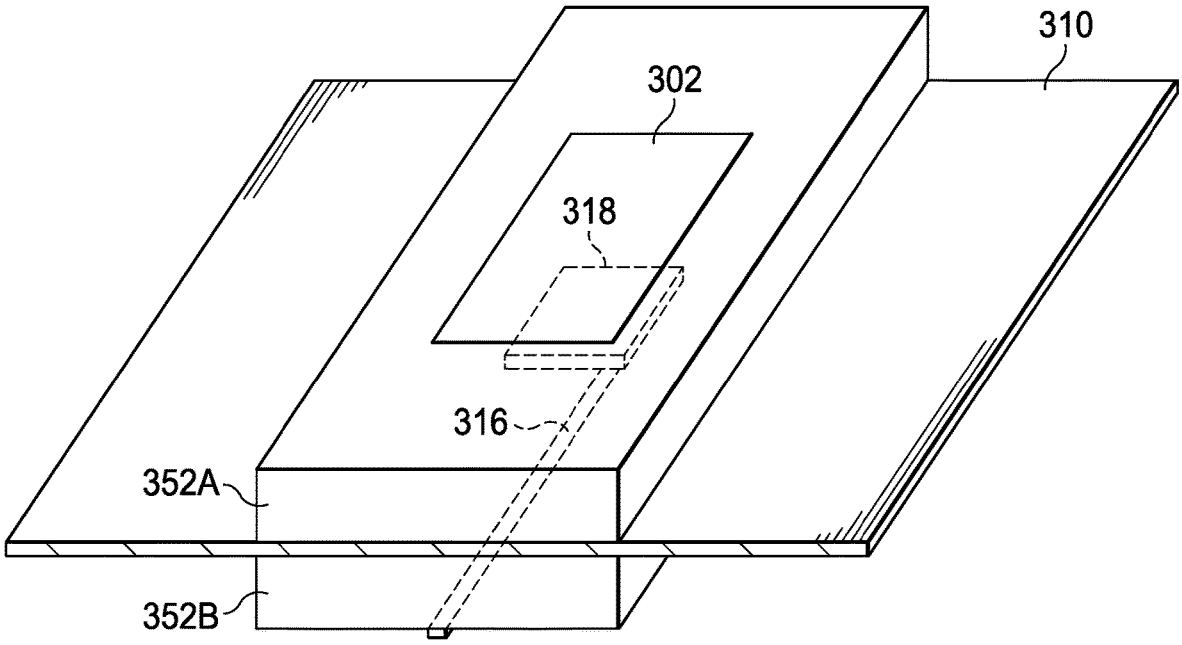

FIG. 3D is a diagram further illustrating the structure of the multi-layer circuit board or substrate in the region of the antenna elements 302. As shown in FIG. 3C, the Rotman lens 222, and circuit traces 316 interconnecting signal processor 224 and Rotman lens 222 are disposed on the bottom surface of the bottom layer 352B, and the conductive ground plane 310 is disposed between the top layer 352A and the bottom layer 352B. FIG. 3D further illustrates that the antenna elements 302 are coupled to the microstrip 316 via an aperture or slot 318 disposed in the ground plane and between each antenna element 302 and the microstrip 316.

In the embodiments illustrated in FIG. 2A and FIG. 3A, the signal processor 224 is disposed within the same housing 256 as the blade antenna 210. The signal processor 224 can also be disposed on the same circuit board having the conductive ground plane 310, as illustrated in FIG. 3A. The IAA 250 can also be implemented on a single layer circuit board, with the conductive ground plane 310 forming the blade antenna, with the Rotman lens 222, circuit traces 316, and processor 224 are disposed on the top of the substrate.

Figure 3E:
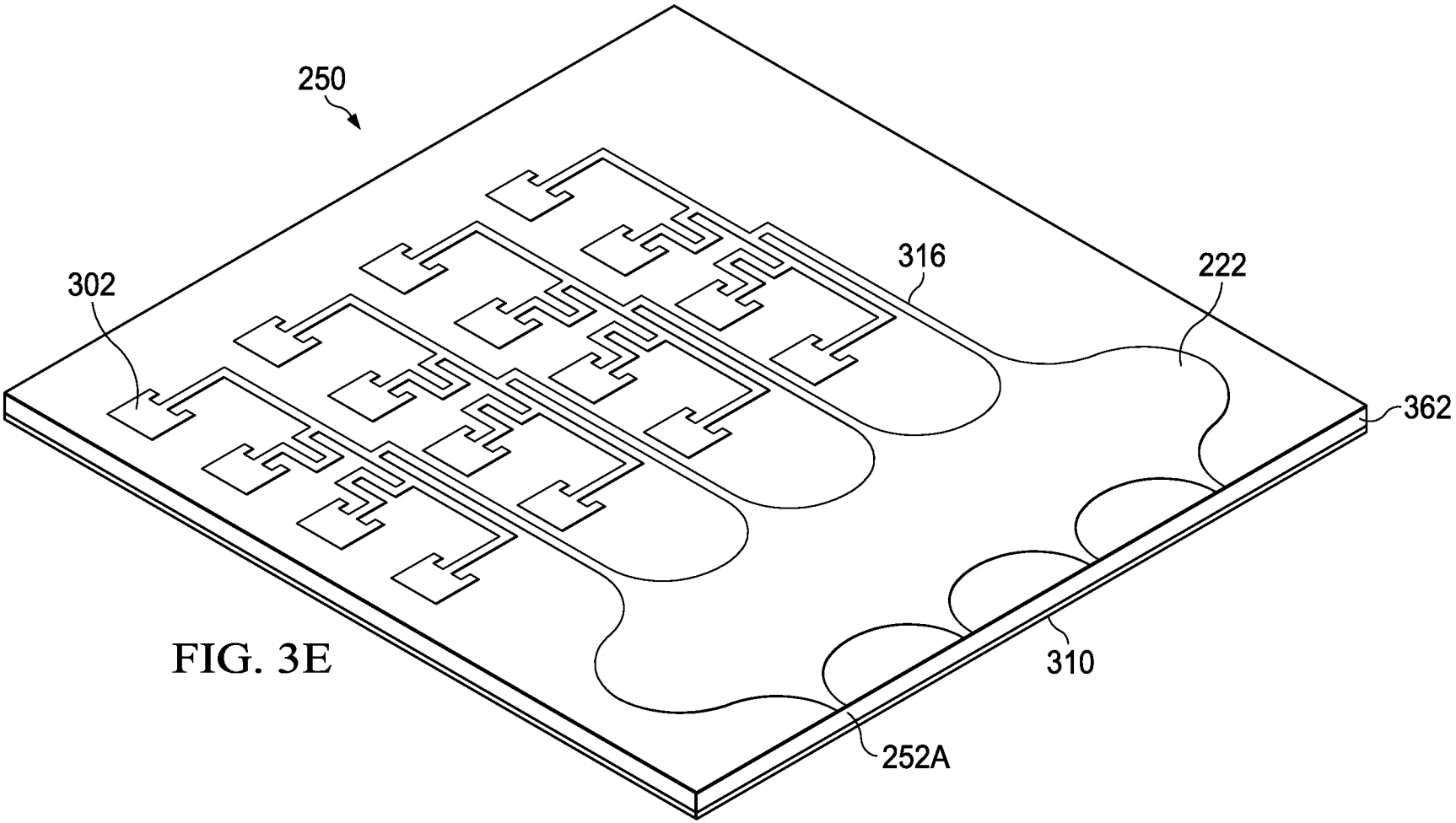
FIG. 3E is a diagram of a single-layer substrate used to implement an embodiment of the integrated antenna assembly.

FIG. 3E is a diagram of exemplary embodiment of the IAA 250 using a single layer substrate 362 or circuit board structure. In this embodiment, the array elements 302, microstrip 316 and Rotman lens 222 are all disposed on one (e.g. top) side of the single layer substrate 362 and interconnecting together, while the conductive ground plane 310 is disposed on the other (e.g. bottom) side of the single substrate 362. Conductive elements on the top side and bottom side of the substrate are separated by a the layer of non-conductive material of the substrate 362.

FIG. 2B and FIG. 3B illustrate another embodiment of the IAA 250 in which the signal processor 224 is not disposed within the same housing 256 nor on the same circuit board as the conductive ground plane 310. In these embodiments, the signal processor 224 can be disposed within an interior volume of the vehicle 104. The circuit traces 316 of the embodiment shown in FIG. 3B and those that follow are analogous to those illustrated in FIG. 3A, but are illustrated as straight lines for purposes of minimizing the complexity of the drawing.

Figure 4B:
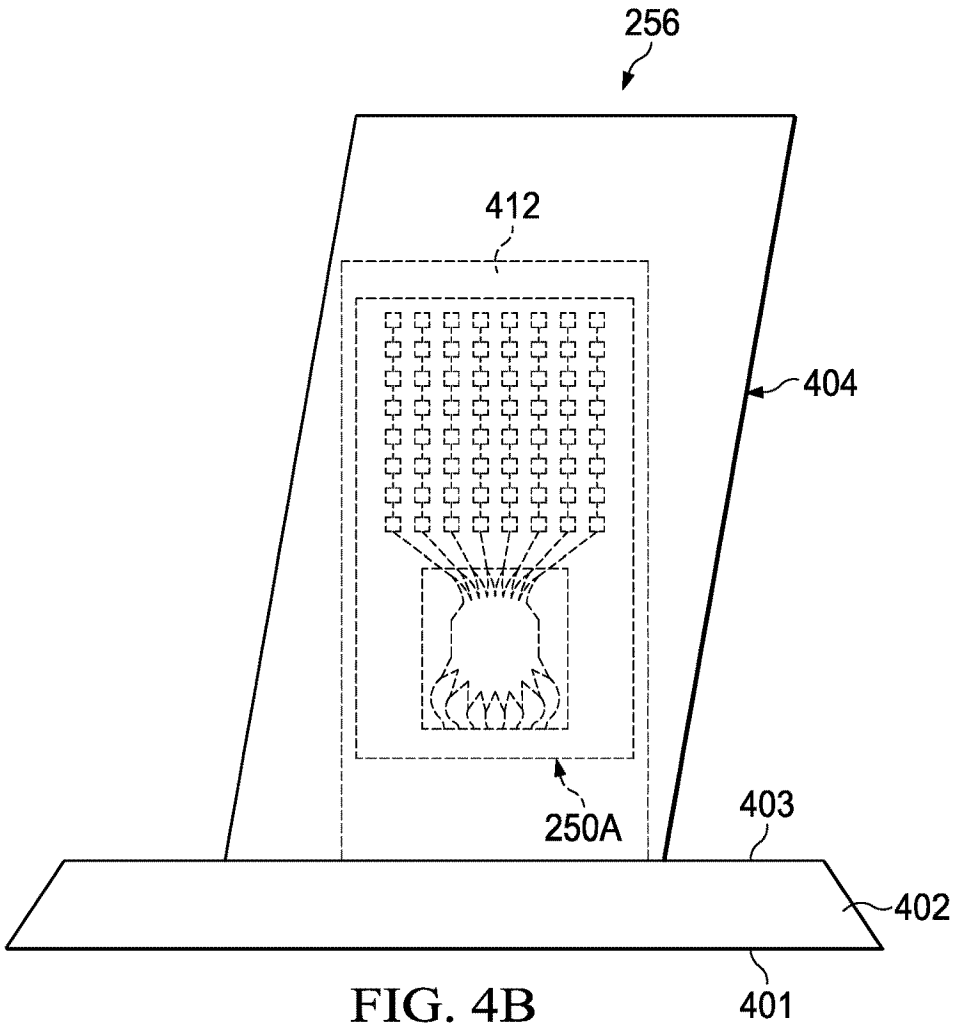
FIGS. 4A-4D are diagrams depicting exemplary antenna modules that use multiple integrated antenna assemblies within a single housing.
Figure 4A:
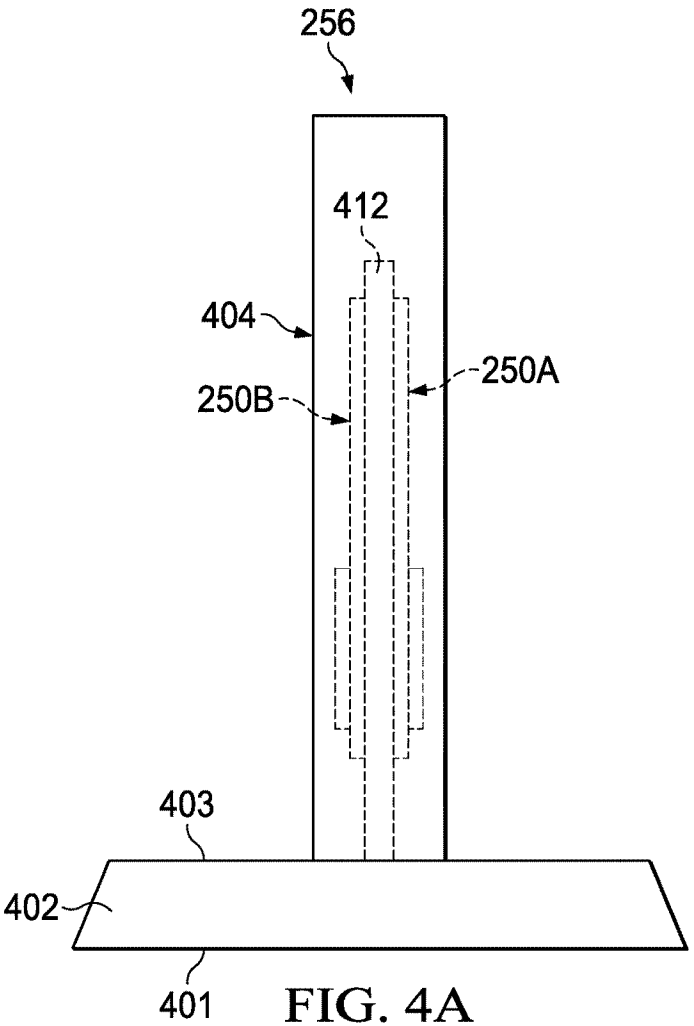

FIGS. 4A and 4B are diagrams depicting exemplary antenna housings 256 that use multiple IAAs 250 within a single housing 256 to collectively provide radiation beams of 360° in azimuth and up 180° in elevation. FIG. 4A presents a front view of the housing 256, while FIG. 4 B presents a side view of the housing 256. The first IAA 250A is mounted within the blade portion 404 on one side of a panel 412, and a second (or further) IAA 250B is mounted to the opposing side of panel 412. Panel 412 is mounted within housing 256, in the housing 256 is mounted to a top side 403 of the base 402. The bottom side 401 of the base 402 is adapted to be mounted to an external surface of the vehicle 104. In embodiments where the vehicle 104 has an outer skin 202 that is transparent to RF energy, the housing 256 can be mounted to an interior surface of the vehicle 104. The blade portion 404 is transparent for RF and microwave energy.

Figure 4D:
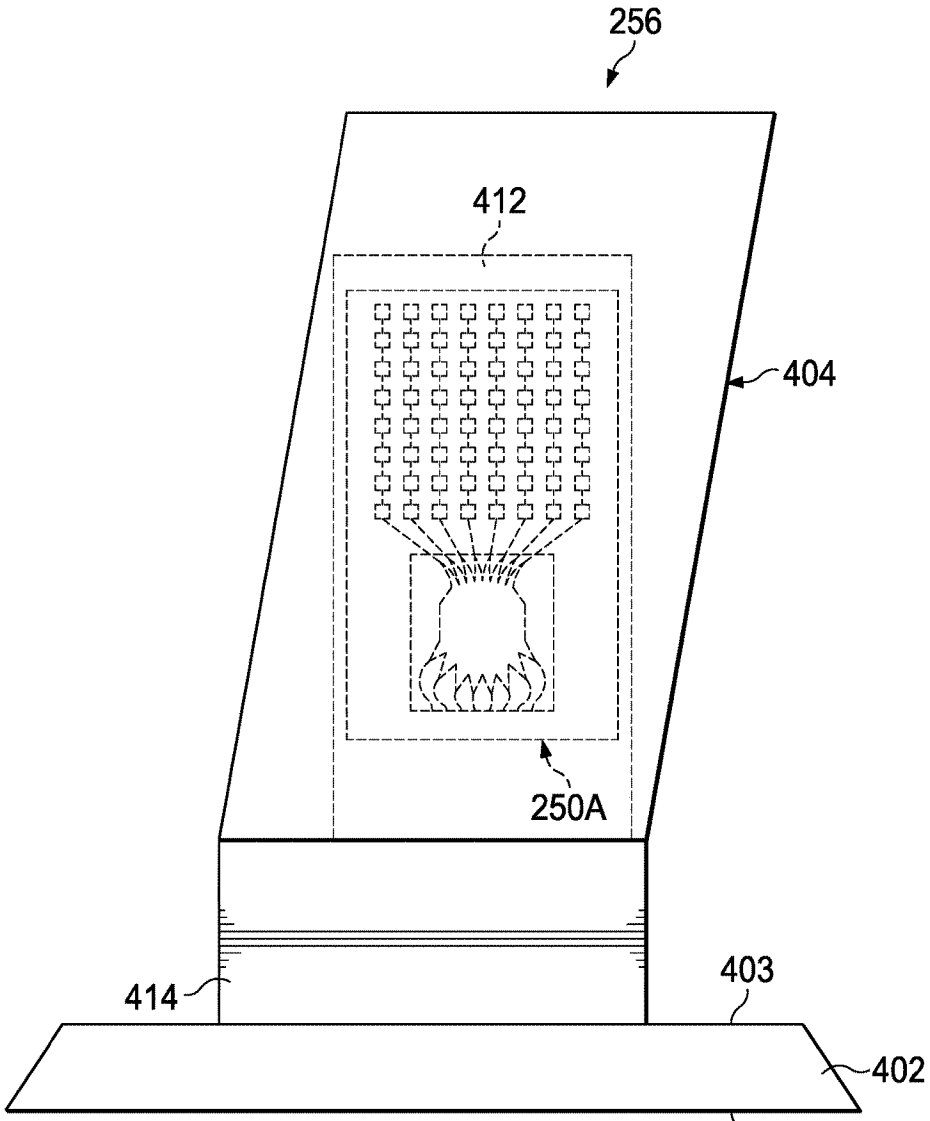
Figure 4C:
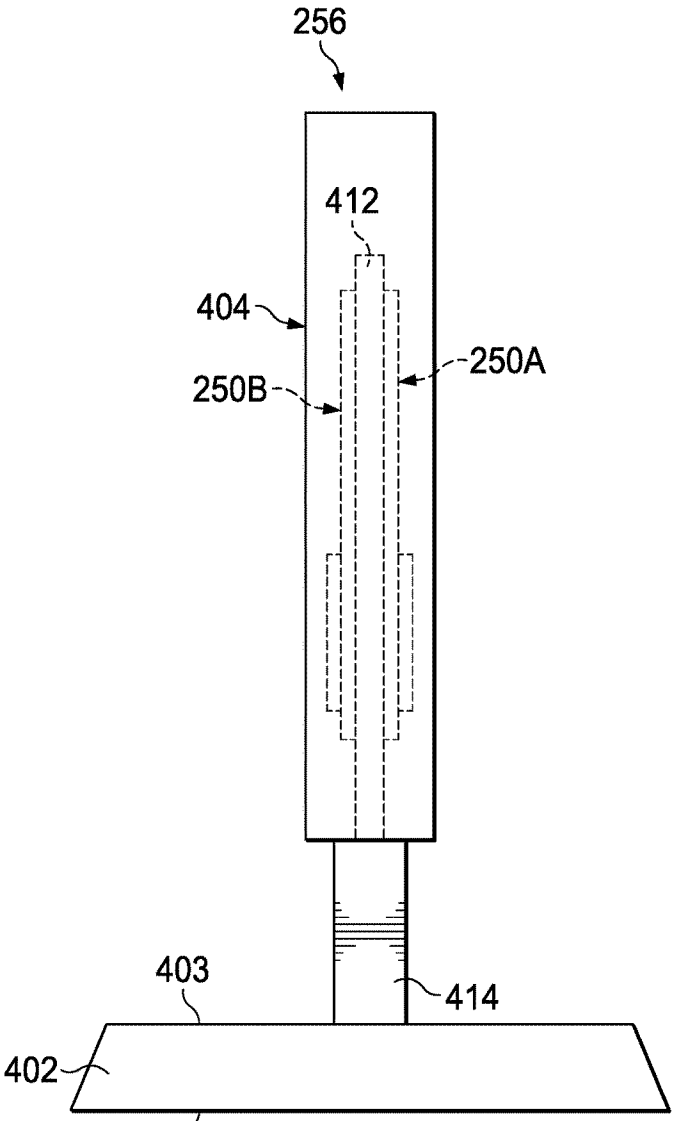

FIGS. 4C and 4D are diagrams depicting an embodiment of the antenna housings 256 that further utilize an extension portion 414 disposed between the antenna housing 256 and the vehicle 104.

Figure 5:
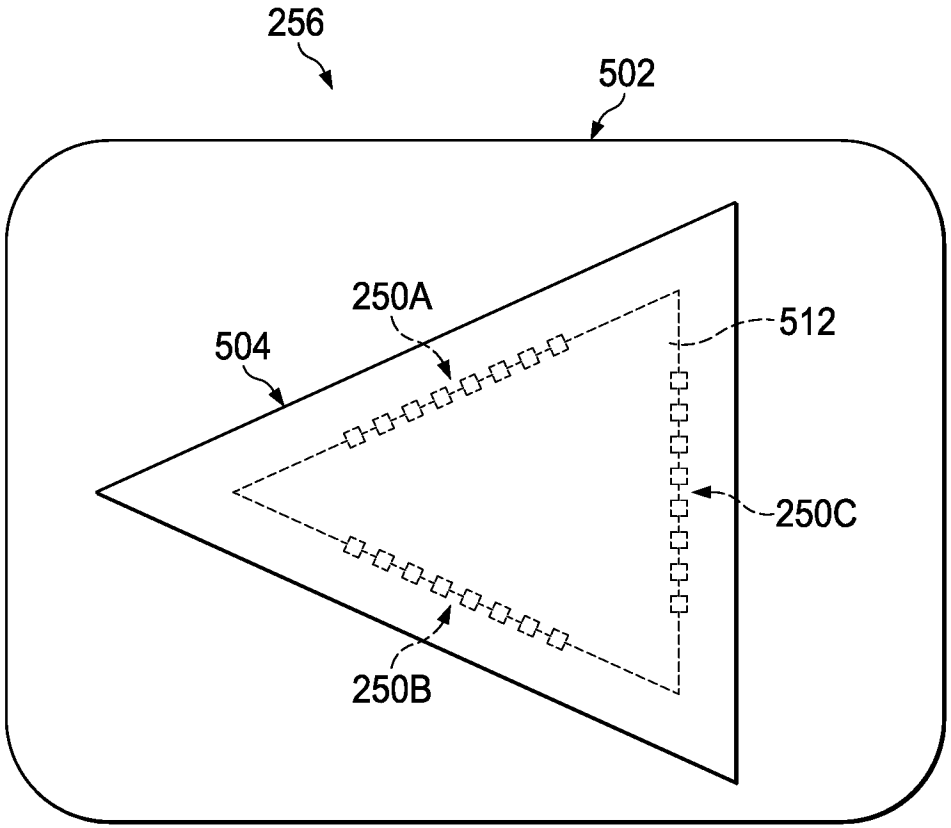
FIGS. 5 and 6 are diagrams depicting the use of multiple integrated antenna assemblies within a single housing.
Figure 6:
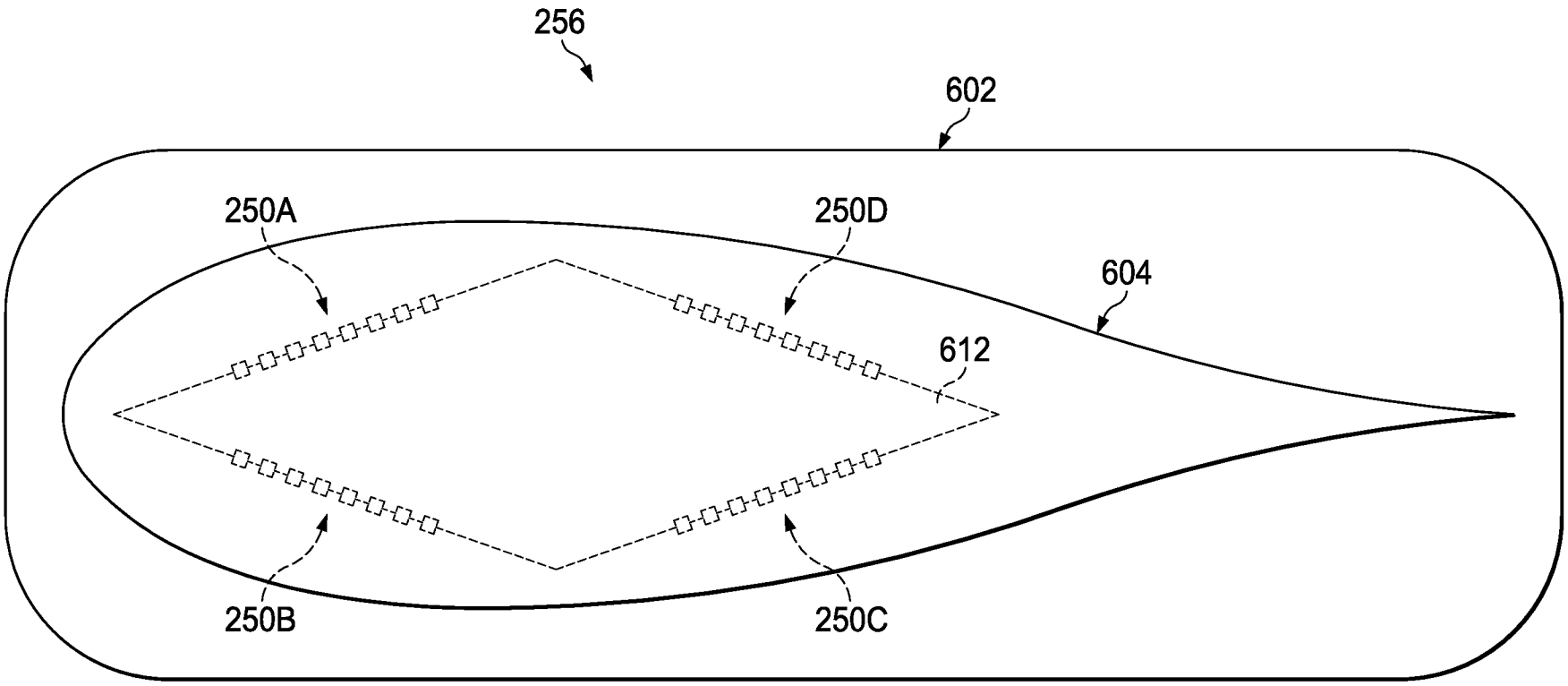

FIGS. 5 and 6 are diagrams depicting the use of multiple IAAs 250 within a single housing. These embodiments require smaller look angles for each of the IAAs 250 with in the housing. FIG. 5 depicts an embodiment using three IAAs 250A-250C, each IAA mounted on a side of a panel 512 that is triangular in cross section. Housing 504 surrounds panel 512, and is also a triangular in cross section. The housing 504 is disposed on base 502.

FIG. 6 depicts an embodiment using four IAAs 250A-250C, each IAA mounted on a side of a panel 512 that is trapezoidal in cross section. FIG. 6 also illustrates the use of an aerodynamic, tear drop shaped housing 604 to surround and protect panel 612. The housing 604 is disposed on base 602 A similarly shaped housing can be used in any of the foregoing embodiments.

Figure 7A:
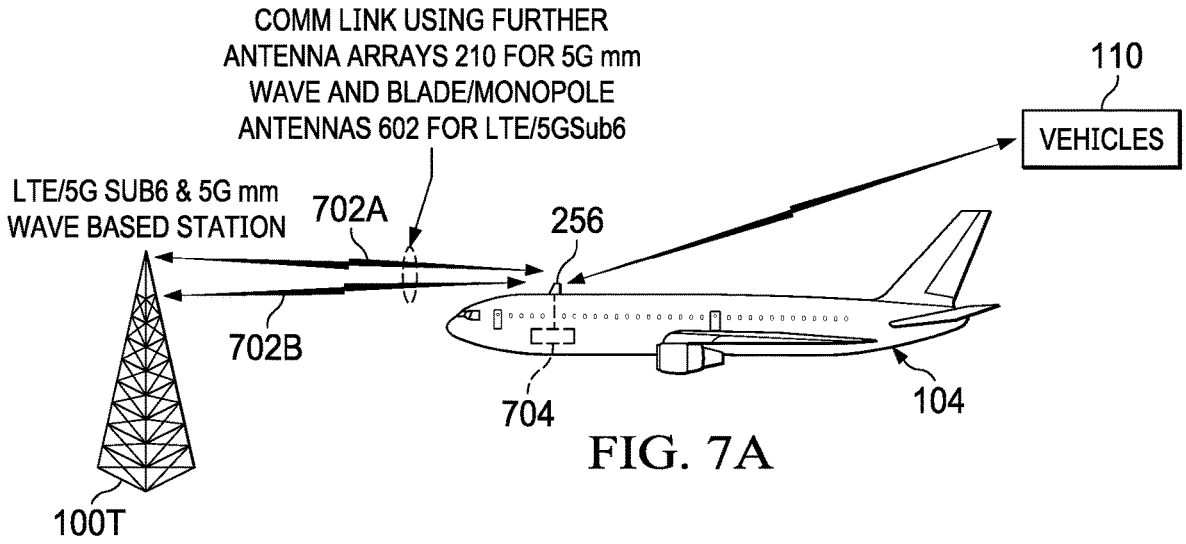
FIGS. 7A and 7B are diagrams illustrating use cases for communicating RF signals.
Figure 7B:
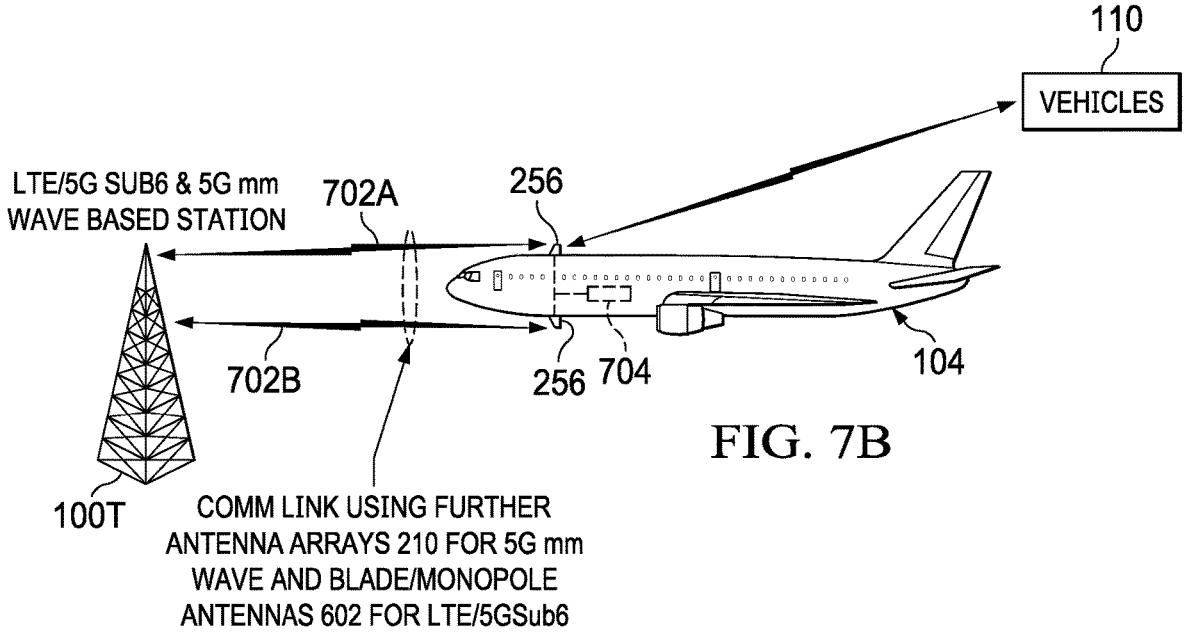

FIGS. 7A and 7B are diagrams illustrating use cases for communicating (transmitting or receiving) RF signals. FIG. 7A is a diagram illustrating a first use case in which a single integrated antenna is utilized, and FIG. 7B is a diagram illustrating a second use case in which two integrated antennas 256 are utilized. In both cases, a first RF signal 702A is communicated in LTE/5Gsub6 wavebands and protocols using the blade antenna 210 of the antenna housing 256. A second RF signal 702B is communicated in 5G mm wave wavebands and protocols using one or more of the planar antenna arrays 220 of the antenna housing 256. In the use case illustrated in FIG. 7B, communications processor 704 determines which of the planar antenna arrays 220 are to be used to communicate the second RF signal 702B, typically selecting the planar antenna array 220 most closely facing in the direction of the station 100T. As illustrated, multiple housings 256 can be utilized.

Figure 8:
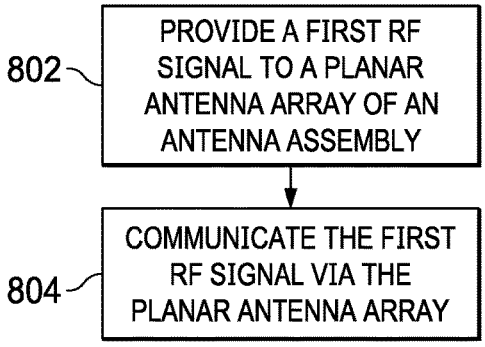
FIGS. 8 and 9 are diagrams illustrating a method of communicating one or more RF signals using the integrated antenna assemblies.

FIG. 8 is a diagram illustrating a method of communicating one or more RF signals using above-described IAAs 250. In block 802, a first RF signal 702A is provided two a planar antenna array of the IAA 250. In block 804 that first RF signal 702A is communicated via the planar antenna array.

Figure 9:
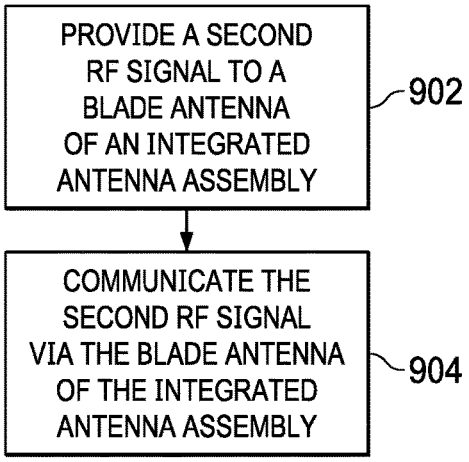

FIG. 9 is a diagram illustrating a method of communicating one or more other RF signals using the above-described IAAs 250. In block 902, a second RF signal 702B is provided to a blade antenna 210 of the IAA 250. In block 904 the second RF signal is communicated via the blade antenna 210 of the IAA 250. The operations depicted in FIG. 9 can be performed concurrently with those of FIG. 8. Thus, the first RF signal 702A and the second RF signal 702B can be communicated at the same time.

Hardware Environment

Figure 10:
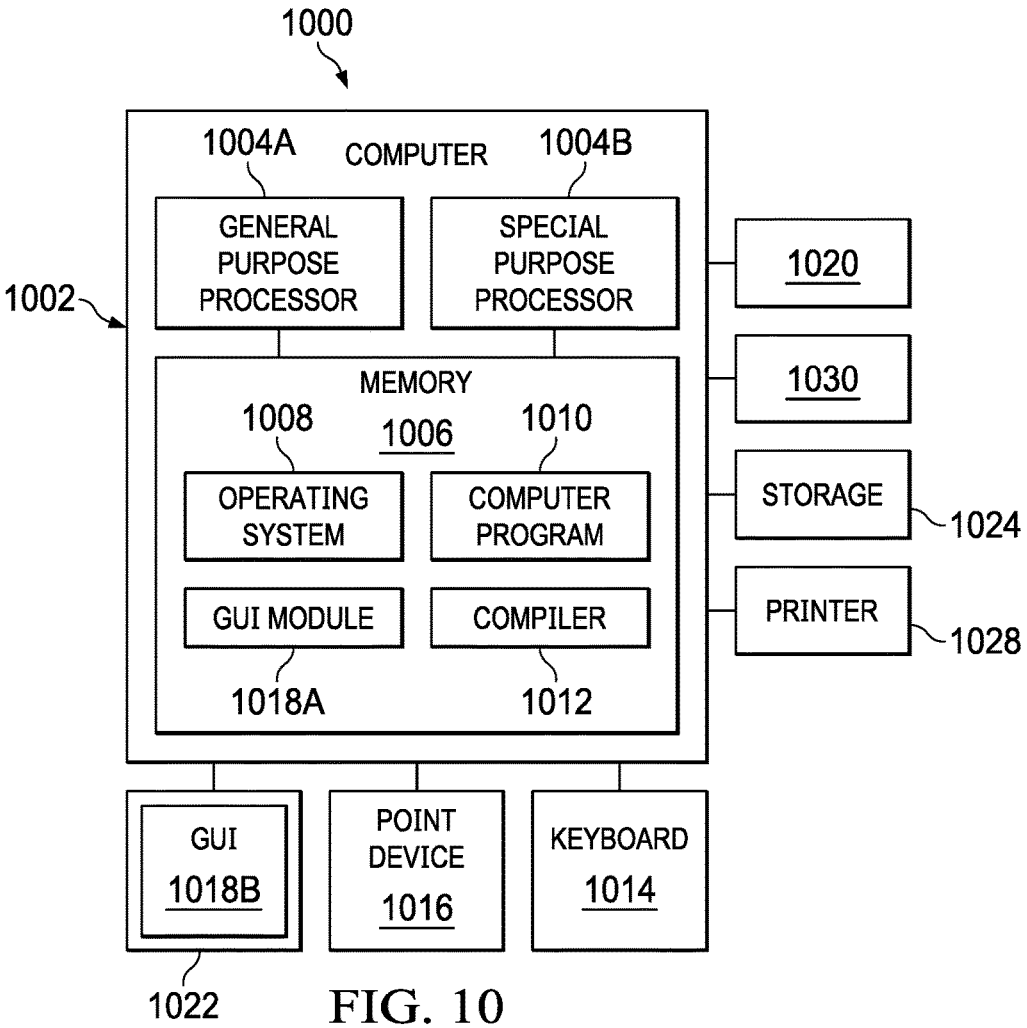
FIG. 10 illustrates an exemplary computer system that could be used to implement processing elements of the above disclosure.

FIG. 10 illustrates an exemplary computer system 1000 that could be used to implement processing elements of the above disclosure, including the communications processor 704. The computer 1002 comprises a processor 1004 and a memory, such as random access memory (RAM) 1006. The computer 1002 is operatively coupled to a display 1022, which presents images such as windows to the user on a graphical user interface 1018B. The computer 1002 can be coupled to other devices, such as a keyboard 1014, a mouse device 1016, a printer 1028, etc. Of course, those skilled in the art will recognize that any combination of the above components, or any number of different components, peripherals, and other devices, can be used with the computer 1002.

Generally, the computer 1002 operates under control of an operating system 1008 stored in the memory 1006, and interfaces with the user to accept inputs and commands and to present results through a graphical user interface (GUI) module 1018A. Although the GUI module 1018B is depicted as a separate module, the instructions performing the GUI functions can be resident or distributed in the operating system 1008, the computer program 1010, or implemented with special purpose memory and processors. The computer 1002 also implements a compiler 1012 which allows an application program 1010 written in a programming language such as COBOL, C++, FORTRAN, or other language to be translated into processor 1004 readable code. After completion, the application 1010 accesses and manipulates data stored in the memory 1006 of the computer 1002 using the relationships and logic that was generated using the compiler 1012. The computer 1002 also optionally comprises an external communication device such as a modem, satellite link, Ethernet card, or other device for communicating with other computers.

In one embodiment, instructions implementing the operating system 1008, the computer program 1010, and the compiler 1012 are tangibly embodied in a computer-readable medium, e.g., data storage device 1020, which could include one or more fixed or removable data storage devices, such as a zip drive, floppy disc drive 1024, hard drive, CD-ROM drive, tape drive, etc. Further, the operating system 1008 and the computer program 1010 are comprised of instructions which, when read and executed by the computer 1002, causes the computer 1002 to perform the operations herein described. Computer program 1010 and/or operating instructions can also be tangibly embodied in memory 1006 and/or data communications devices 1030, thereby making a computer program product or article of manufacture. As such, the terms "article of manufacture," "program storage device" and "computer program product" as used herein are intended to encompass a computer program accessible from any computer readable device or media.

Those skilled in the art will recognize many modifications can be made to this configuration without departing from the scope of the subject disclosure. For example, those skilled in the art will recognize that any combination of the above components, or any number of different components, peripherals, and other devices, can be used.

The foregoing discloses an antenna assembly, including: a blade antenna for communicating a first signal; a planar antenna array for communicating a second signal, the planar antenna array including: an array of antenna elements, the array of antenna elements including a plurality antenna elements arranged in rows using the blade antenna as a conductive ground plane; a Rotman lens, formed by using the blade antenna as the conductive ground plane, the Rotman lens having a set of Rotman lens array ports and a set of Rotman lens beam ports, each element of a respective row of the antenna elements communicatively coupled to a respective one port of the set of Rotman lens array ports; a signal processor, having: a set of signal processor first ports, each signal processor first port communicatively coupled to a respective one of the set of Rotman lens beam ports; a second signal processor port, the second signal processor port for communicating the second signal; and wherein the signal processor selectively couples the second signal processor port to one or more of the signal processor first ports.

Implementations may include one or more of the following features:

The antenna assembly of the claim above, wherein: the Rotman lens is disposed on a first side of a substrate; and the blade antenna is formed by a conductive ground plane for the planar antenna array on a second side of the substrate.

The antenna assembly of any of the claims above wherein: the antenna assembly includes a multi-layer substrate including a first substrate and a second substrate; the array of antenna elements is disposed on a top side of the first substrate; the blade antenna is formed by a conductive ground plane for the planar antenna array.

The antenna assembly of any of the claims above may also include disposed between the first substrate and the second substrate; the Rotman lens is disposed on a bottom side of the second substrate, and each antenna element of the respective row of the antenna elements is communicatively coupled to the respective ports of the set of Rotman lens array ports via microstrip conductors disposed on the bottom side of the second substrate and slots disposed in the conductive ground plane beneath each antenna element.

The antenna assembly of any of the claims above further including: an antenna housing having a plurality of sides including a first side and a second side; a further planar antenna array, for communicating the second signal, the further planar antenna array including: a further array of antenna elements, the further array of antenna elements including a plurality of further antenna elements arranged in further rows; a further Rotman lens having a set of further Rotman lens array ports and a set of further Rotman lens beam ports, each element of a respective further row communicatively coupled to a respective one of further Rotman lens array ports; wherein: the planar antenna array is mounted on the first side of the antenna housing; the further planar antenna array is mounted on the second side of the antenna housing; the signal processor includes: a set of signal processor further first ports, each signal processor further first port communicatively coupled to a respective one of the set of further Rotman lens beam ports; a second port, the second port for communicating the second signal; and wherein the signal processor further selectively couples the second port to one or more of the signal processor further first ports.

The antenna assembly of any of the claims above may also include the signal processor is mounted external to the antenna housing.

The antenna assembly of any of the claims above wherein: the antenna housing is mounted to an external surface of a vehicle and wherein the signal processor is disposed within an interior volume of the vehicle.

The antenna assembly of any of the claims above, wherein: the antenna housing is mounted to an external surface of a vehicle and wherein the signal processor is disposed within the antenna housing.

The antenna assembly of any of the claims above, wherein: the planar antenna array and the further planar antenna array are directed to collectively provide radiation beams of 360 degrees in azimuth and up to 180 degrees in elevation.

The antenna assembly of any of the claims above, wherein: the plurality of sides includes a third side, the antenna housing having a triangular cross section; and the third side includes a third planar antenna array.

The antenna assembly of any of the claims above, wherein: the plurality of sides includes a fourth side, the antenna housing having a trapezoidal cross section; and the fourth side includes a fourth planar antenna array.

The antenna assembly of any of the claims above, wherein: a set of Rotman lens ports include the a set of Rotman lens array ports and the set of Rotman lens beam ports, and wherein the Rotman lens passively transforms a further signal presented at a port of the set of Rotman lens ports from a first phase and first amplitude to one or more signals at one or more other ports of the set of Rotman lens ports having a second phase and second amplitude.

The antenna assembly of any of the claims above, wherein: the first signal is in a first frequency band and the second signal is in a second frequency band higher than the first frequency band. The antenna assembly wherein the first frequency band is below 6 GHz and the second frequency band is 7 to 86 GHz or X, Ku, K, Ka and V-band.

The antenna assembly of any of the claims above, wherein: the blade antenna is formed by a conductive layer of a substrate.

The antenna assembly of any of the claims above, wherein: each row of the antenna elements is communicatively coupled to a respective one of the set of Rotman lens array ports via a microstrip feed.

The antenna assembly of any of the claims above wherein: each signal processor first port is communicatively coupled to a respective one of the set of Rotman lens beam ports by an associated second microstrip conductor.

Another embodiment is evidenced by a method of communicating one or more a radio frequency (RF) signals via an antenna assembly, including: providing at least one of a first radio frequency (RF) signal and a second RF signal to a planar antenna array of an antenna assembly, the antenna assembly including: a blade antenna; the planar antenna array that is configured to utilize the blade antenna as a conductive ground plane, the planar antenna array including: an array of antenna elements, the array of antenna elements including a plurality antenna elements arranged in rows; and a Rotman lens, using the blade antenna as the conductive ground plane, the Rotman lens having a set of Rotman lens array ports and a set of Rotman lens beam ports, each element of a respective row of the antenna elements communicatively coupled to a respective one port of the set of Rotman lens array ports; and a signal processor, having: a set of signal processor first ports, each signal processor first port communicatively coupled to a respective one of the set of Rotman lens beam ports; a second signal processor port, the second signal processor port for communicating the second RF signal. The method of communicating one or more also includes wherein the signal processor selectively couples the second signal processor port to one or more of the signal processor first ports. The method of communicating one or more also includes communicating at least one of the first RF signal via the blade antenna and the second RF signal via the planar antenna array.

Implementations may include one or more of the following features:

The method described above, further including: the first RF signal is communicated via the blade antenna and the second RF signal is communicated via the planar antenna array; wherein: the first RF signal is in a first frequency band; the second RF signal is in a second frequency band; the first frequency band is below 6 GHz and the second frequency band is 7 to 86 GHz or X, Ku, K, Ka and V-band; and the first RF signal and the second RF signal are communicated concurrently.

Another embodiment is evidenced by a method of assembling an aircraft having a fuselage, including: disposing an antenna assembly on a skin of the fuselage, the antenna assembly, including: a blade antenna for communicating a first signal; a planar antenna array for communicating a second signal, the planar antenna array including: an array of antenna elements, the array of antenna elements including a plurality antenna elements arranged in rows using the blade antenna as a conductive ground plane; a Rotman lens, formed by using the blade antenna as the conductive ground plane, the Rotman lens having a set of Rotman lens array ports and a set of Rotman lens beam ports, each element of a respective row of the antenna elements communicatively coupled to a respective one port of the set of Rotman lens array ports; a signal processor, having: a set of signal processor first ports, each signal processor first port communicatively coupled to a respective one of the set of Rotman lens beam ports; a second signal processor port, the second signal processor port for communicating the second signal; and wherein the signal processor selectively couples the second signal processor port to one or more of the signal processor first ports and the blade antenna and the planar antenna array are disposed on an opposing side of the skin from the signal processor.

Implementations may include one or more of the following features:

The method described above, wherein: the Rotman lens is disposed on a first side of a substrate; and the blade antenna is formed by a conductive ground plane for the planar antenna array on a second side of the substrate.

Any of the methods described above, wherein: the antenna assembly includes a multi-layer substrate including a first substrate and a second substrate; the array of antenna elements is disposed on a top side of the first substrate; the blade antenna is formed by a conductive ground plane for the planar antenna array.

CONCLUSION

This concludes the description of the embodiments of the subject disclosure. The foregoing description of the embodiments has been presented for the purposes of illustration and description. It is not intended to be exhaustive or to limit the disclosure to the precise form disclosed. Many modifications and variations are possible in light of the above teaching. It is intended that the scope of rights be limited not by this detailed description, but rather by the claims appended hereto.

To the extent that terms "includes," "including," "has," "contains," and variants thereof are used herein, such terms are intended to be inclusive in a manner similar to the term "comprises" as an open transition word without precluding any additional or other elements.

What is claimed is:

1. An antenna assembly, comprising:

a blade antenna for communicating a first signal;

a planar antenna array for communicating a second signal, the planar antenna array comprising:

an array of antenna elements, the array of antenna elements comprising a plurality antenna elements arranged in rows using the blade antenna as a conductive ground plane;

a Rotman lens, formed by using the blade antenna as the conductive ground plane, the Rotman lens having a set of Rotman lens array ports and a set of Rotman lens beam ports, each element of a respective row of the antenna elements communicatively coupled to a respective one port of the set of Rotman lens array ports;

a signal processor, having:

a set of signal processor first ports, each signal processor first port communicatively coupled to a respective one of the set of Rotman lens beam ports;

a second signal processor port, the second signal processor port for communicating the second signal; and wherein the signal processor selectively couples the second signal processor port to one or more of the signal processor first ports.

2. The antenna assembly of claim 1, wherein:

the Rotman lens is disposed on a first side of a substrate; and the blade antenna is formed by the conductive ground plane for the planar antenna array on a second side of the substrate.

3. The antenna assembly of claim 1, wherein:

the antenna assembly comprises a multi-layer substrate comprising a first substrate and a second substrate;

the array of antenna elements is disposed on a top side of the first substrate;

the blade antenna is formed by a conductive ground plane for the planar antenna array, disposed between the first substrate and the second substrate;

the Rotman lens is disposed on a bottom side of the second substrate; and each antenna element of the respective row of the antenna elements is communicatively coupled to the respective ports of the set of Rotman lens array ports via microstrip conductors disposed on the bottom side of the second substrate and slots disposed in the conductive ground plane beneath each antenna element.

4. The antenna assembly of claim 1, further comprising:

an antenna housing having a plurality of sides including a first side and a second side;

a further planar antenna array, for communicating the second signal, the further planar antenna array comprising:

a further array of antenna elements, the further array of antenna elements comprising a plurality of further antenna elements arranged in further rows;

a further Rotman lens having a set of further Rotman lens array ports and a set of further Rotman lens beam ports, each element of a respective further row communicatively coupled to a respective one of further Rotman lens array ports;

wherein:

the planar antenna array is mounted on the first side of the antenna housing;

the further planar antenna array is mounted on the second side of the antenna housing;

the signal processor comprises:

a set of signal processor further first ports, each signal processor further first port communicatively coupled to a respective one of the set of further Rotman lens beam ports;

the signal processor further selectively couples the second signal processor port to one or more of the signal processor further first ports.

5. The antenna assembly of claim 4, wherein:

the antenna housing is mounted to an external surface of a vehicle and wherein the signal processor is disposed within an interior volume of the vehicle.

6. The antenna assembly of claim 4, wherein:

the antenna housing is mounted to an external surface of a vehicle and wherein the signal processor is disposed within the antenna housing.

7. The antenna assembly of claim 6, wherein:

the planar antenna array and the further planar antenna array are directed to collectively provide radiation beams of 360 degrees in azimuth and up to 180 degrees in elevation.

8. The antenna assembly of claim 4, wherein:

the plurality of sides comprises a third side, the antenna housing having a triangular cross section; and the third side comprises a third planar antenna array.

9. The antenna assembly of claim 4, wherein:

the plurality of sides comprises a third side and a fourth side, the antenna housing having a trapezoidal cross section;

the third side comprises a third planar antenna array; and the fourth side comprises a fourth planar antenna array.

10. The antenna assembly of claim 1, wherein a set of Rotman lens ports comprise the set of Rotman lens array ports and the set of Rotman lens beam ports, and wherein the Rotman lens passively transforms the second signal presented at a port of the set of Rotman lens ports from a first phase and first amplitude to one or more signals at one or more other ports of the set of Rotman lens ports having a second phase and second amplitude.

11. The antenna assembly of claim 1, wherein the first signal is in a first frequency band and the second signal is in a second frequency band higher than the first frequency band.

12. The antenna assembly of claim 11, wherein:

the first frequency band is below 6 GHz;

the second frequency band is within 7 to 86 GHz; and the first signal and the second signal are communicated simultaneously.

13. The antenna assembly of claim 1, wherein the blade antenna is formed by a conductive layer of a substrate.

14. The antenna assembly of claim 13, wherein each row of the antenna elements is communicatively coupled to a respective one of the set of Rotman lens array ports via a microstrip feed.

15. The antenna assembly of claim 14, wherein:

each signal processor first port is communicatively coupled to a respective one of the set of Rotman lens beam ports by an associated second microstrip conductor.

16. A method of communicating one or more a radio frequency (RF) signals via an antenna assembly, comprising:

providing at least one of a first radio frequency (RF) signal and a second RF signal to a planar antenna array of an antenna assembly, the antenna assembly comprising:

a blade antenna;

the planar antenna array that is configured to utilize the blade antenna as a conductive ground plane, the planar antenna array comprising:

an array of antenna elements, the array of antenna elements comprising a plurality antenna elements arranged in rows; and a Rotman lens, using the blade antenna as the conductive ground plane, the Rotman lens having a set of Rotman lens array ports and a set of Rotman lens beam ports, each element of a respective row of the antenna elements communicatively coupled to a respective one port of the set of Rotman lens array ports; and a signal processor, having:

a set of signal processor first ports, each signal processor first port communicatively coupled to a respective one of the set of Rotman lens beam ports;

a second signal processor port, the second signal processor port for communicating the second RF signal; and wherein the signal processor selectively couples the second signal processor port to one or more of the signal processor first ports; and communicating at least one of the first RF signal via the blade antenna and the second RF signal via the planar antenna array.

17. The method of claim 16, further comprising:

the first RF signal is communicated via the blade antenna and the second RF signal is communicated via the planar antenna array;

wherein:

the first RF signal is in a first frequency band;

the second RF signal is in a second frequency band;

the first frequency band is below 6 GHz and the second frequency band is 7 to 86 GHz; and the first RF signal and the second RF signal are communicated concurrently.

18. A method of assembling an aircraft having a fuselage, comprising:

disposing an antenna assembly on a skin of the fuselage, the antenna assembly comprising:

a blade antenna for communicating a first signal;

a planar antenna array for communicating a second signal, the planar antenna array comprising:

an array of antenna elements, the array of antenna elements comprising a plurality antenna elements arranged in rows using the blade antenna as a conductive ground plane;

a Rotman lens, formed by using the blade antenna as the conductive ground plane, the Rotman lens having a set of Rotman lens array ports and a set of Rotman lens beam ports, each element of a respective row of the antenna elements communicatively coupled to a respective one port of the set of Rotman lens array ports;

a signal processor, having:

a set of signal processor first ports, each signal processor first port communicatively coupled to a respective one of the set of Rotman lens beam ports;

a second signal processor port, the second signal processor port for communicating the second signal; and wherein the signal processor selectively couples the second signal processor port to one or more of the signal processor first ports, and the blade antenna and the planar antenna array are disposed on an opposing side of the skin from the signal processor.

19. The method claim 18, wherein:

the Rotman lens is disposed on a first side of a substrate; and the blade antenna is formed by a conductive ground plane for the planar antenna array on a second side of the substrate.

20. The method of claim 18, wherein:

the antenna assembly comprises a multi-layer substrate comprising a first substrate and a second substrate;

the array of antenna elements is disposed on a top side of the first substrate;

the blade antenna is formed by a conductive ground plane for the planar antenna array, disposed between the first substrate and the second substrate;

the Rotman lens is disposed on a bottom side of the second substrate; and each antenna element of the respective row of the antenna elements is communicatively coupled to the respective ports of the set of Rotman lens array ports via microstrip conductors disposed on the bottom side of the second substrate and slots disposed in the conductive ground plane beneath each antenna element.

* * * * *